United States Patent [19]

Imberg et al.

[11] 3,956,608

[45] May 11, 1976

[54] ENERGY SEAL FOR A MICROWAVE OVEN

[75] Inventors: Bengt Uno Imberg; George Gustav Orke, both of Norrkoping, Sweden

[73] Assignee: U.S. Philips Corporation, New York, N.Y.

[22] Filed: Oct. 10, 1972

[21] Appl. No.: 295,800

[30] Foreign Application Priority Data

Oct. 19, 1971 Sweden ..... 13212/71

[52] U.S. Cl. ..... 219/10.55 D

[51] Int. Cl.[2] ..... H05B 9/06

[58] Field of Search ..... 219/10.55, 10.55 C, 219/10.55 D

[56] References Cited

UNITED STATES PATENTS

| | | | |
|---|---|---|---|
| 3,436,508 | 4/1969 | Fritz | 219/10.55 D |
| 3,584,177 | 6/1971 | Bucksbaum | 219/10.55 |
| 3,678,238 | 7/1972 | Yasuoka et al. | 219/10.55 |
| 3,699,299 | 10/1972 | Umezo et al. | 219/10.55 |
| 3,803,377 | 4/1974 | Nakano | 219/10.55 D |
| 3,835,283 | 9/1974 | Suzuki | 219/10.55 D |

*Primary Examiner*—Bruce A. Reynolds
*Attorney, Agent, or Firm*—Frank R. Trifari

[57] ABSTRACT

In a microwave oven use is made of a combination of a sealing in the form of a quarter-wave choke, arranged in the edge of the door, and a safety switch which is operated by the door. The entrance opening to the quarter-wave choke is situated at such a distance from the outer edge of the door that the sealing is still fully effective at the instant at which the safety switch is actuated by the opening of the door.

14 Claims, 3 Drawing Figures

ENERGY SEAL FOR A MICROWAVE OVEN

Figure 4:
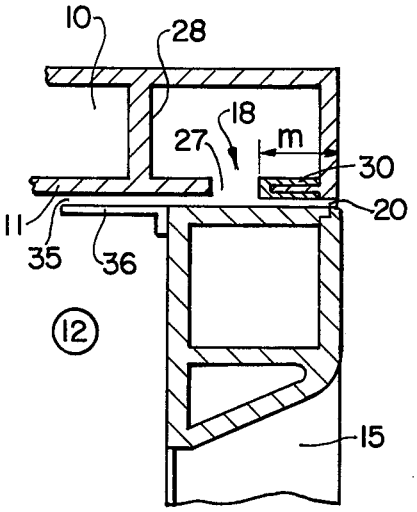

The invention relates to a microwave oven comprising an envelope having an inner wall which defines an oven cavity and an access opening which can be closed by means of a door. The oven further comprises means for feeding energy into the cavity. The enclosure is provided at the area of the opening with a projecting frame having an inner surface which encloses a space which can accommodate the door in the closed position, a gap remaining between the inner surface of the frame and the edge of the door. The gap constitutes a communication path between the oven cavity and the surrounding environment. A quarter-wave choke is arranged in the edge of the door or in the said frame so as to prevent energy from leaking away from the oven cavity via the said gap. A door-operated safety switch is provided so as to interrupt the supply of microwave energy to the oven cavity in the case of a given displacement of the door when it is opened.

A problem in microwave ovens is to prevent the leakage of energy near the door opening between the oven enclosure and the edges of the door. A solution to this problem which has the advantage that no galvanic contact is required between the door and the enclosure, but instead a gap is provided between the door and the enclosure, is formed by a so-called quarter-wave choke arranged in the door or in the enclosure at the area where the enclosure and the door overlap each other. The quarter-wave choke consists of a groove which is provided in a conductive material and which has a depth which is equal to one quarter of the wavelength of the frequency of the electromagnetic radiation used in the microwave oven. So as to ensure effective damping in the quarter-wave choke, the distance between the opening of the said groove and the area where the energy leaks from a oven cavity into the gap which leads to the groove must be substantially equal to one quarter wavelength. The quarter-wave choke is usually formed in those surfaces of the door or the enclosure which are situated in the same plane as the opening, but it is also known to arrange the quarter-wave choke in the edge of the door. This edge is then enveloped with some clearance by a frame which projects from the enclosure.

Another problem in such an oven is to prevent energy from being supplied to the oven cavity when the door is open. This problem is usually solved by means of at least one door-operated safety switch which interrupts the supply of energy to the oven cavity when the door is opened. This switch also acts as a safety device against radiation of energy if the door is accidentally opened while the microwave source is still switched on and delivering energy to the oven cavity. However, before a safety switch of this kind functions, the door must have been moved over a given distance and under these circumstances inadmissible quantities of energy can radiate to the outside environment before the safety switch functions.

An object of the invention is to solve this problem by providing an energy seal which has the ame effectiveness during the entire opening motion until the actuation instant of the safety switch as when the door is fully closed. To achieve this end, the invention is characterized in that, when the door is closed, the distance between the entrance opening to the quarter-wave choke and the outer edge of the said frame is larger than the distance over which the edge of the door must be displaced so as to actuate. The safety switch, the gap between the frame and the edge of the door communicates with the oven cavity via a slot between, on the one side, a surface of the enclosure which adjoins the said inner surface of the frame and, on the other side, a surface on the side of the door which adjoins the edge of the door. If the entrance opening to the quarter-wave choke is situated rather near to the inner wall of the door, which results in maximum freedom of movement for the door while a completely effective sealing action is maintained, the said slot only will form the entrance path to the quarter-wave choke, and this slot must then have a length which is substantially equal to one quarter wavelength.

Figure 1:
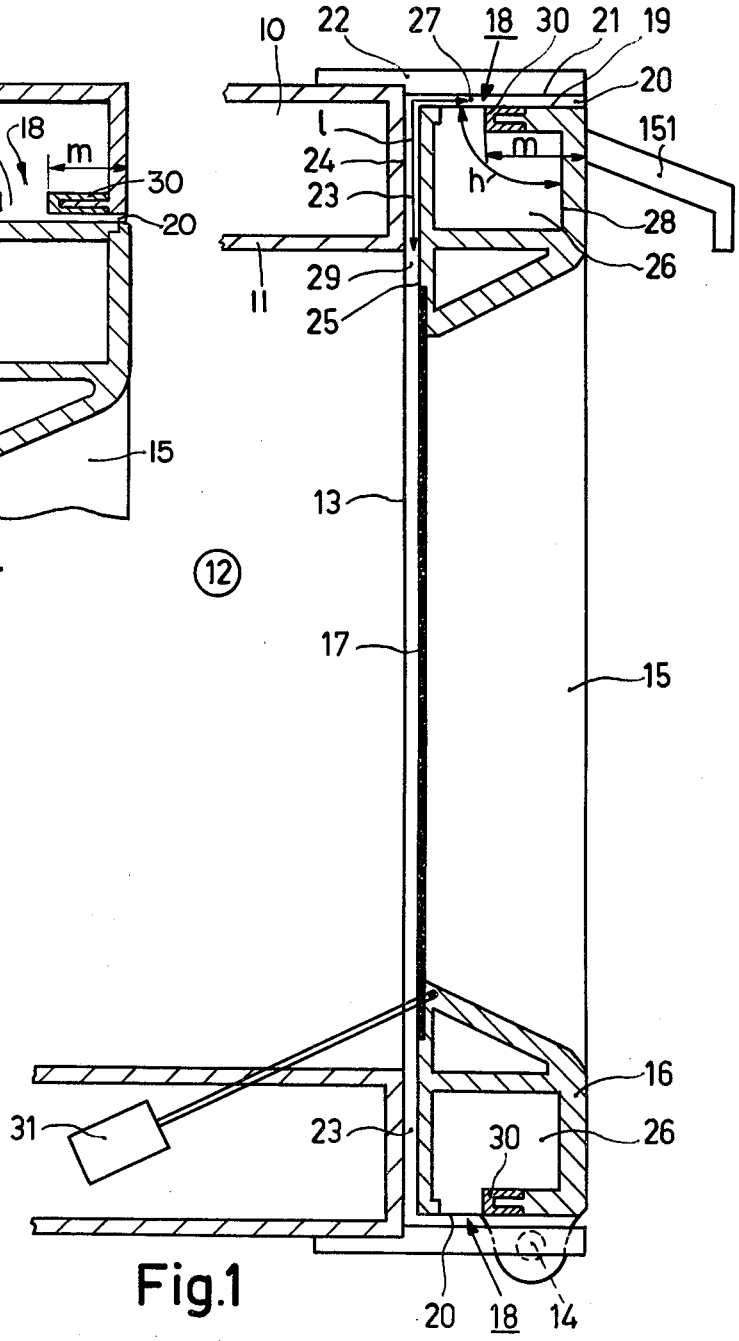
Figure 2:
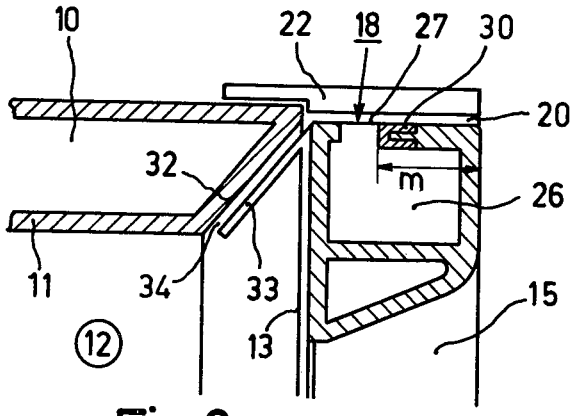
Figure 3:
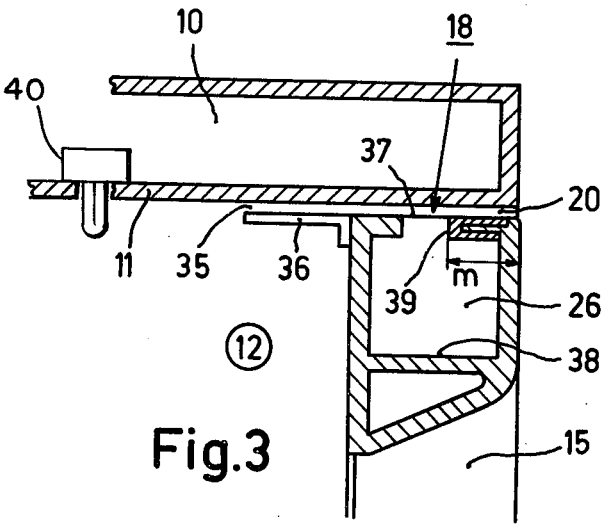

The invention now will be described in greater detail with reference to the accompanying drawing in which:

FIG. 1 is a diagrammatic sectional view through the front part of a first embodiment of a microwave oven according to the invention, and FIGS. 2, 3 and 4 show details of other embodiments of the microwave oven according to the invention.

As is shown in FIG. 1, the microwave oven comprises an enclosure 10 having an inner wall 11 which limits an oven cavity 12. Microwave energy can be supplied from a microwave source to the oven cavity 12 by means not shown. The oven cavity 12 is accessible via an opening 13 in the front of the enclosure. This opening can be closed by means of a door 15 which hinges on a shaft 14. The door 15 in the embodiment shown consists of a frame 16, having a central opening covered by a metal plate 17 which may be perforated. The plate 17 prevents microwave energy from leaking through the door 15, while the perforations enable observation of the interior of the oven cavity 12.

So as to prevent energy from leaking away between the enclosure 10 and the door 15 at the area of the opening 13, a so-called quarter-wave choke 18 is provided along the entire circumference of the door in the edge 19 thereof. This quarter-wave choke 18 opens into a gap 20 which is formed between the edge 19 of the door 15 and the inner surface 21 of a frame 22 which projects from the enclosure 10. By means of spacers (not shown), a slot 23 is maintained between a front face 24 of the enclosure 10 and the inner wall 25 of the door 15, the said slot 23 forming a communication path between the quarter-wave choke 18 and the oven cavity 12.

The quarter-wave choke 18 consists, in known manner, of a groove 26 which is filled with a dielectric material, the said groove having a depth $h$ which is equal, calculated from the entrance opening 27 to a short-circuit surface 28, to one quarter of the wavelength of the frequency of the electromagnetic radiation used in this dielectric. In the embodiment shown, the entrance opening 27 to the groove 26 is situated rather near to the inner wall 25 of the oven door. The distance $l$ between the opening 27 of the groove 26 and the beginning 29 of the slot 23 is also substantially equal to one quarter wavelength. The short-circuit surface 28 in the groove 26, consequently, is situated at substantially one half wavelength from the entrance 29 of the slot 23, which means that the impedance for energy which leaks away at the area of said entrance will amount to approximately zero so that energy leakage is prevented. Moreover, any energy still leaking away along the quarter wave choke 18 is damped by means of an energy absorbing material 30 which is provided behind the quarter-wave choke in the edge 19 of the door 15 (viewed in the direction in which the energy leaks away). The absorbing material 30 can be provided along the gap 20 in any arbitrary location behind the quarter-wave choke 18.

In order to interrupt the supply of microwave energy to the oven cavity 12 when the door 15 is opened, at least one door-operated safety switch is provided which is diagrammatically shown at 31. The safety switch 31 is actuated and interrupts the supply of energy to the oven cavity 12 when the door 15 is swung out over a given angle. The distance *m* between the entrance 27 to the quarter-wave choke 18 and the outer edge of the projecting frame 22 which envelops the door 15 in the closed position is chosen to be larger than the distance over which the part of the edge 19 which covers the largest distance during opening is to be displaced so as to actuate the safety switch. The quarter-wave choke 18 is then fully effective during the entire opening movement until the safety switch 31 is actuated so that leakage of energy is thus prevented should the door 15 be accidentally opened while the microwave source is still switched on.

Usually a second safety switch (not shown) is provided which is actuated by the door 15 or by a grip 151 by means of which the door is opened. In the latter case the supply of energy is interrupted when the locking mechanism of the grip is released. If two safety switches are provided, it is necessary that both switches be individually effective so as to prevent leakage of energy when one of the switches is defective. This implies that even if the second safety switch is actuated by the grip 151 so that it does not require an opening motion of the door 15 in order to be actuated, it is still necessary to satisfy the requirement that the first safety switch 31, actuated by the door, must be actuated before dangerous quantities of energy can leak away in the case of an unintentional opening of the door if the second switch were defective.

A second embodiment of the energy seal described with reference to FIG. 1 is shown in FIG. 2. In this case the enclosure 10 is provided around the opening 13 with a front face 32 which, contrary to the front face 24 shown in FIG. 1, encloses an acute angle with the plane of the opening. Provided on the inside of the door 15, along the entire circumference thereof, is a strip 33 which is substantially parallel to the front face 32. By means of spacers (not shown), a given distance is maintained between the front face 32 and the strip 33 when the door 15 is in the closed position. As a result a slot 34 is formed which constitutes a communication path between the oven cavity 12 and the quarter-wave choke 18. The length of the slot 34 is again substantially equal to one quarter wavelength and the construction of the quarter-wave choke 18 is generally the same as shown in FIG. 1.

FIG. 3 shows a third embodiment of the energy seal in which the door 15 is completely enclosure by the envelope 10 and does not face any front face of the enclosure. A magnetron 40 is located on top of the oven cavity 12 for supplying microwave energy thereto. In this embodiment a strip 36 which is parallel to the inner wall 11 of the enclosure 10 is connected to the door 15. Between this strip and the inner wall 11 a slot 35 is again provided which constitutes the communication path between the oven cavity 12 and the quarter-wave choke 18. In order to ensure that the overall width of the door 15 and the strip 36 does not become too large, it is possible, as is shown in FIG. 3, to displace the entrance opening 37 to the quarter-wave choke 18 in the direction of the outside of the door. Obviously, it is still necessary to satisfy the requirement that the safety switch 31 must be actuated by the door 15 before the energy seal becomes ineffective due to the fact that the entrance opening 37 of the quarter-wave choke 18 lies outside the enclosure 10. In the case of such a location of the entrance opening 37, it may be necessary to construct the quarter-wave choke 18 such that the bottom wall 38 serves as the short-circuit surface. FIG. 3 also shows a damping device comprising an absorbing material 39 which extends over the entire length of the gap 20 behind the quarter-wave choke 18 (viewed in the direction in which the energy leakage occurs). In the latter two embodiments, the slots 34, 35 can also be formed between the wall of the enclosure 10 and a suitable surface of the door 15 itself, provided that an adequate thickness is chosen for this door.

The described quarter-wave choke 18 in the edge 19 of the door 15 can alternatively be omitted in the part of the edge where the shaft 14 is situated. The quarter-wave choke 18 must then be replaced in this area by a common quarter-wave choke in the front part of the enclosure 10 or on the inside of the door 15. In a further embodiment, shown in FIG. 4 wherein like elements contain the same reference numerals as in FIGS. 1 and 3, the quarter wave choke 18 is formed in an inner surface of the frame or enclosure 10. If desired, the quarter-wave choke 18 in the edge 19 can also be combined with any further energy seals which are provided in known manner in the front part of the enclosure 10 or on the inside of the door 15.

What is claimed:

1. A microwave oven comprising an enclosure having an inner wall which defines an oven cavity and an access opening, a door for closing said opening, means for feeding microwave energy into the cavity, said enclosure being provided at the area of the opening with a projecting frame having an inner surface which encloses a space which can accommodate the door in the closed position so that a gap remains between the inner surface of the frame and the edge of the door, said gap constituting a communication path between the oven cavity and the outside environment, a quarter-wave choke arranged along a part of said gap with its entrance opening arranged along the gap so as to prevent energy from leaking away from the oven cavity via the gap, a door-operated safety switch operatively coupled to the door for interrupting the supply of microwave energy to the oven cavity upon a given displacement of the door when the door is opened from the closed position, the distance, when the door is closed, between said entrance opening of the quarter-wave choke and the outer edge of said frame being larger than the distance through which the edge of the door must be displaced from the closed position so as to actuate the safety switch, the gap communicating with the oven cavity via a slot formed between, on the one side, a surface of the enclosure which adjoins the said inner surface of the frame and, on the other side, a surface on the inside of the door which adjoins the edge of the door.

2. A microwave oven as claimed in claim 1, characterized in that the said slot is situated between a front face of the enclosure, which is situated in the plane of the access opening and the inside of the door.

3. A microwave oven as claimed in claim 1 wherein said slot is situated between a front face of the enclosure which forms an acute angle with the plane of the opening, and a surface on the inside of the door which is substantially parallel to said front face.

4. A microwave oven as claimed in claim 3, characterized in that the said surface on the inside of the door is formed by a metal strip which is connected to the door.

5. A microwave oven as claimed in claim 1, in which the door is completely enclosed by the oven enclosure in its closed position, said frame formed as a unitary structure with the front part of the inner wall of the enclosure, and wherein said slot is situated between the inner wall of the enclosure and a strip parallel thereto and connected to the door, the slot being situated in the same plane as the gap between the edge of the door and the frame.

6. A microwave oven as claimed in claim 1 wherein said quarter-wave choke comprises a groove formed in the peripheral edge of the door.

7. A microwave oven as claimed in claim 1 wherein said quarter-wave choke comprises a groove formed in the inner surface of said frame.

8. A microwave oven comprising a metallic enclosure having walls which define an oven cavity and having an access opening in one of said walls, a door for closing said opening, means for supplying microwave energy into the oven cavity, said enclosure including a projecting frame surrounding said opening and having an inner wall surface in opposed relationship to and enclosing the peripheral edge surface of the door in the closed position thereof so as to form a gap therebetween which provides a communication path between the oven cavity and the outside environment, a quarter wave choke comprising a groove formed in one of said opposed surfaces to prevent the leakage of microwave energy from the cavity to the outside environment via said gap, the origin of the choke being arranged along the gap, a door-operated safety switch operatively coupled to the door for interrupting the supply of microwave energy to the oven cavity upon a given displacement of the door from the fully closed position, the length of said gap from the origin of the choke to the outer edge of the frame being greater than the given displacement distance of the door for actuating the switch whereby the energy seal is effective during said given displacement of the door.

9. A microwave oven as claimed in claim 8 wherein said enclosure and door are arranged with further opposed surfaces that form a slot between the oven cavity and the origin of the groove to complete the communication path, including said gap, between the oven cavity and the outside environment.

10. A microwave oven as claimed in claim 9 wherein the walls of the enclosure and the peripheral edge of the door are arranged so that the slot and gap are formed in non-parallel planes.

11. A microwave oven as claimed in claim 9 wherein the length of the slot is one quarter wavelength at the frequency of the microwave energy.

12. A microwave oven as claimed in claim 9 wherein the walls of the enclosure and the peripheral edge of the door are arranged so that the slot and gap are formed in parallel aligned planes.

13. A microwave oven comprising a metallic housing having walls which define an oven cavity with an access opening in one of said walls, a door for closing said opening, means for supplying microwave energy to the oven cavity, said one housing wall and said door having opposed surfaces in the closed position of the door that form a slot for preventing the escape of microwave energy from the oven cavity, said housing including a projecting portion surrounding said opening and having an inner wall surface in opposed relationship to and enclosing the peripheral edge surface of the door in the closed position thereof so as to form a gap therebetween which provides a communication path between the oven cavity and the outside environment, a quarter wave choke comprising a groove formed in one of the opposed surfaces that defines said gap for preventing the escape of microwave energy from the oven cavity, the entrance origin of said choke being arranged along the gap, and a door-operated safety switch operatively coupled to the door for interrupting the supply of microwave energy to the oven cavity upon a given displacement of the door from the fully closed position, the length of said gap from the origin of the choke to the outer edge of the door being greater than the given displacement distance of the door for actuating the switch whereby the energy seal is effective during said given displacement of the door.

14. A microwave oven as claimed in claim 13 wherein the length of the slot is one quarter wavelength at the microwave frequency and further comprising a microwave energy absorbent material located in one of the opposed surfaces defining said gap, said slot, said gap and said absorbent material being arranged in series relationship in the direction of escaped microwave energy from the oven cavity.

* * * * *

UNITED STATES PATENT AND TRADEMARK OFFICE

CERTIFICATE OF CORRECTION

PATENT NO. : 3,956,608

DATED : May 11, 1976

INVENTOR(S) : Bengt Uno Imberg et al

It is certified that error appears in the above-identified patent and that said Letters Patent are hereby corrected as shown below:

col. 1, line 5, cancel "envelope" and insert -- enclosure --;

line 38, cancel "a" and insert -- the --; cancel "the" (2nd occurr.) and insert -- a --;

line 62, cancel "ame" and insert -- same --;

col. 2, line 2, cancel ". The" and insert -- the --; cancel ", the" and insert -- . The --;

line 31, cancel the comma (,);

col. 3, line 58, cancel "enclosure" and insert -- enclosed --;

line 59, cancel "envelope" and insert -- enclosure --;

IN THE CLAIMS claim 5, line 3, after "frame" insert -- being --;

Signed and Sealed this

Fifth Day of October 1976

[SEAL]

*Attest:*

RUTH C. MASON
*Attesting Officer*

C. MARSHALL DANN
*Commissioner of Patents and Trademarks*